US006857155B2

(12) United States Patent
Yorigami et al.

(10) Patent No.: US 6,857,155 B2
(45) Date of Patent: Feb. 22, 2005

(54) AUTOMATIC LEVEL-CONTROL FLOATING APPARATUS

(75) Inventors: Shigeyuki Yorigami, Kobe (JP); Etsuyoshi Oda, Kobe (JP)

(73) Assignee: Yorigami Kensetsu Kabushiki Kaisha, Kobe (JP)

( * ) Notice: Subject to any disclaimer, the term of this patent is extended or adjusted under 35 U.S.C. 154(b) by 0 days.

(21) Appl. No.: 10/750,809

(22) Filed: Jan. 5, 2004

(65) Prior Publication Data

US 2004/0148715 A1 Aug. 5, 2004

(30) Foreign Application Priority Data

Jan. 9, 2003 (JP) ..... 2003-003184
Oct. 20, 2003 (JP) ..... 2003-359428

(51) Int. Cl.[7] ..... E01D 15/14
(52) U.S. Cl. ..... 14/27; 14/2.6; 114/266
(58) Field of Search ..... 14/2, 4, 2.6, 27–30, 14/78; 114/264–267, 330, 333, 33, 45, 256

(56) References Cited

U.S. PATENT DOCUMENTS 981,991 A * 1/1911 Forrsell ..... 14/28
1,367,115 A * 2/1921 Blondel ..... 14/28
3,656,198 A * 4/1972 Haensgen ..... 14/2.6
3,689,953 A * 9/1972 Markakis ..... 14/27
3,949,564 A * 4/1976 Nord ..... 405/205
4,312,287 A * 1/1982 Kuo ..... 114/259
4,426,949 A * 1/1984 Knutsen ..... 114/47
5,131,109 A * 7/1992 Grip et al. ..... 142/8
5,727,491 A * 3/1998 Emrich et al. ..... 114/27
6,058,869 A * 5/2000 Thon ..... 114/125
6,575,105 B1 * 6/2003 Zingale ..... 114/52
6,718,901 B1 * 4/2004 Abbott et al. ..... 114/264

FOREIGN PATENT DOCUMENTS

JP 11-172620 6/1999

* cited by examiner

*Primary Examiner*—Robert E. Pezzuto
*Assistant Examiner*—Alexandra K. Pechhold
(74) *Attorney, Agent, or Firm*—Wenderoth, Lind & Ponack, L.L.P.

(57) ABSTRACT

An automatic level-control floating apparatus supports a pontoon bridge, a floating floor or another superstructure floating on the sea, where the height of tide or the sea level varies. It is difficult to maintain the level of such a superstructure, which the floating apparatus can keep at a constant level without using motive power.

The floating apparatus includes a supporting tank 3, which rests on the water bottom. The top of the supporting tank 3 is open to the atmosphere. A piston body 1 can reciprocate vertically in the supporting tank 3. The apparatus also includes floating tanks 2, which are integral with and positioned outside the piston body 1. The tops of the floating tanks 2 are open to the atmosphere. The floating tanks 2 are floating on the water. A floating body 4 can move vertically in each floating tank 2 and supports the superstructure. The interior of each floating tank 2 and the interior of the supporting tank 3 are connected by an elastic or flexible communicating tube 5, through which liquid can flow between them.

14 Claims, 9 Drawing Sheets

(a)

(b)

(a)

(b)

AUTOMATIC LEVEL-CONTROL FLOATING APPARATUS

BACKGROUND OF THE INVENTION

The present invention relates to an automatic level-control floating apparatus, which supports a superstructure and constantly controls the level (vertical position) of the supported superstructure. The superstructure may be a pontoon bridge or a floor that floats on the sea.

In order to eliminate the need to adjust the level of a known pontoon bridge, which may vary in level, a long movable ramp is provided between the bridge and the land. Because the ramp slopes as the pontoon bridge varies in level, it cannot be used where it needs to be horizontal.

The pontoon of another known pontoon bridge is fitted with ballast pumps for pumping water into and from the pontoon to adjust the level of the bridge. For example, reference may be made to Japanese Unexamined Patent Publication No. H11-172620 (paragraph 0009, FIG. 1). Because the ballast pumps need to keep operating, the pontoon bridge requires high running costs for the operation, maintenance, etc. of the pumps.

In general, the foundations of the piers of bridges constructed on the sea etc. need to be laid on firm ground. If the foundations are laid on very soft ground, or if they are very deep in water, the construction costs of the bridges are very high.

SUMMARY OF THE INVENTION

The object of the present invention is to provide an automatic level-control floating apparatus including a displacer-type float that makes it possible to reduce the equipment and running costs.

The present invention is based on the fact that the level of the superstructure resting on the floating bodies in the floating tanks of the displacer-type float can be kept constant regardless of the variation in tide level or the like. The invention is also based on the fact the displacer-type float is moved by its buoyancy and needs no motive power.

An automatic level-control floating apparatus according to a first aspect of the present invention comprises a fixed casing, a piston body, a floating tank, a floating body and a communicating line. The fixed casing rests on the water bottom or is supported by a support set on the water bottom. The top of the fixed casing is open to the atmosphere. The fixed casing is filled with liquid. The piston body is floating on the liquid in the fixed casing in such a manner that this body can move vertically. The piston body is integral with the floating tank, which is positioned outside it. The floating tank is floating on the water and filled with liquid. The top of the floating tank is open to the atmosphere. The floating body is floating on the liquid in the floating tank in such a manner that this body can move vertically. The floating body supports the bottom of a superstructure above the water. The interior of the floating tank and the interior of the fixed casing are connected by the communicating line, through which the liquid can flow between the tank and the casing so that the level of the floating body can be controlled automatically.

When the water level rises, the floating tank moves upward together with the piston body. This makes the liquid level in the fixed casing lower than that in the floating tank, so that a portion of the liquid in the tank flows into the casing. Consequently, the liquid level in the floating tank lowers relatively.

In other words, as the piston body moves upward in the fixed casing, a portion of the liquid under the floating body in the floating tank flows into the casing so that the floating body moves downward in the tank. The upward displacement of the floating tank is roughly equal to the downward displacement of the floating body in this tank. As a result, the level of the floating body is kept roughly constant. Likewise, when the water level drops, the level of the floating body is kept roughly constant.

Thus, when the displacer-type float including the piston body and the floating tank moves vertically, a portion of the liquid flows through the communicating line between the tank and the fixed casing, so that the liquid levels in the tank and the casing become the same.

The fixed casing needs to rest on the water bottom directly or with a support interposed between them. Only part of the load of the floating apparatus acts on the support, because buoyancy acts on the floating tank, which is integral with the piston body. Accordingly, the load acting on the support is roughly equal to only the load of the fixed casing, so that the support can be simple in structure.

The simple support can be low in strength and light in weight as compared with a structure set up on the water bottom. Even if the water bottom is soft, the simple support can be set up without being reinforced by means of large-scale ground improvement or the like.

It is preferable that the communicating line be a flexible and elastic tube, which can follow the floating tank without breaking even if this tank is displaced greatly relative to the fixed casing.

A plurality of automatic level-control floating apparatuses according to the first aspect may be provided and spaced from each other. A superstructure is positioned over the floating apparatuses. A connector is interposed between the superstructure and the floating body of one of the floating apparatuses. The connector allows the superstructure and the floating body to be displaced relative to each other.

The cross-sectional areas of the piston body and the interior of the floating tank or the ratio between them depends on the composition of the vertical displacement of the floating body due to its buoyancy and the displacement of the liquid level in the floating tank. These areas or the ratio between them may be determined suitably so that the level of the floating body can be kept constant even when this body is displaced vertically by a change of tide level. It is preferable that the cross-sectional area ratio be about 1.

The absolute change of the liquid level (the absolute movement of the floating body) in the floating tank depends on the ratio between the cross-sectional areas of the piston body and the interior of the floating tank. If this ratio is 1, the vertical displacement of the floating body is 0. Accordingly, even when the displacer-type float is moved vertically by a change of tide level, the level of the floating body is kept constant.

The superstructure may be a pontoon bridge. This makes it easy to control the level of the pontoon bridge.

An automatic level-control floating apparatus according to a second aspect of the present invention comprises a support, an annular fixed casing, an annular piston body, a floating tank, a floating body and a communicating line. The support is set on the water bottom. The annular fixed casing is supported by the support. The top of the fixed casing is open to the atmosphere. The fixed casing is filled with liquid. The annular piston body is floating on the liquid in the fixed casing in such a manner that this body can move vertically. The floating tank is integral with and positioned within the piston body. The floating tank is floating on the water. The top of the floating tank is open to the atmosphere. The floating tank is filled with liquid. The floating body is floating on the liquid in the floating tank in such a manner that this body can move vertically. The floating body supports the bottom of a superstructure above the water. The interior of the floating tank and the interior of the fixed casing are connected by the communicating tube, through which the liquid can flow between the tank and the casing so that the level of the floating body can be controlled automatically. The superstructure may be a floor floating on the sea or the water.

The support may comprise a tension anchor, which includes an anchor fixed to the water bottom and a chain or a wire rope connecting the anchor and the fixed casing.

The floating apparatus according to the present invention does not need a pump or other machinery or equipment for level control, and accordingly does not require electric or motive power. This makes it possible to greatly cut down the running costs for the operation, maintenance, etc. of the apparatus.

In particular, because the displacer-type float (the piston body and floating tank) of the floating apparatus is not fixed to the ground, it can be less affected by earthquakes than general bridges, for which foundations need to be built. If the fixed casing is built on the ground in consideration of the ground-water level etc., the casing needs no great bearing power. This is economical if the ground is very soft or if the water is very deep.

DETAILED DESCRIPTION OF THE PREFERRED EMBODIMENTS

Figure 1:
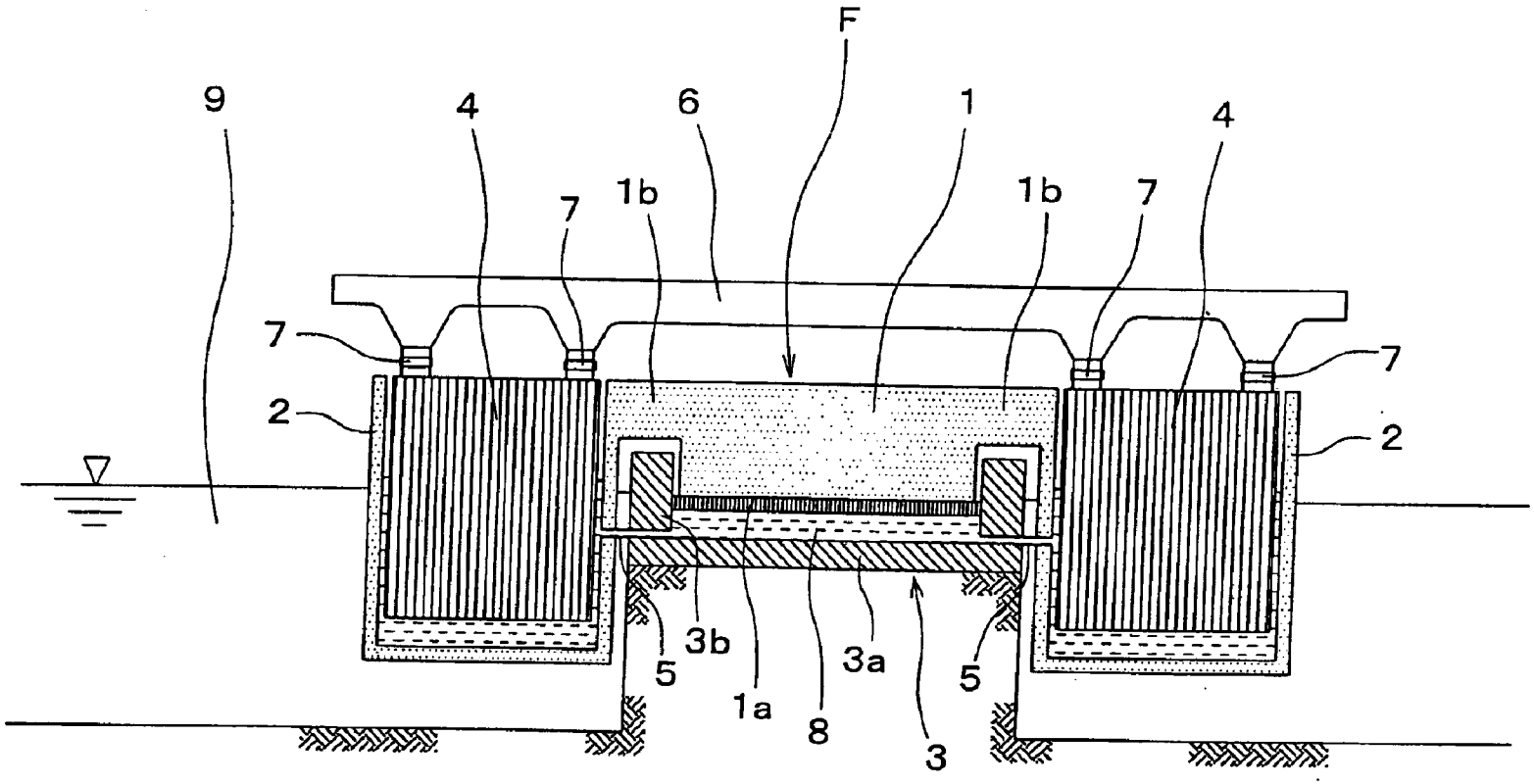
FIG. 1 is a vertical section of an automatic level-control floating apparatus according to a first embodiment of the present invention at low tide.
Figure 2:
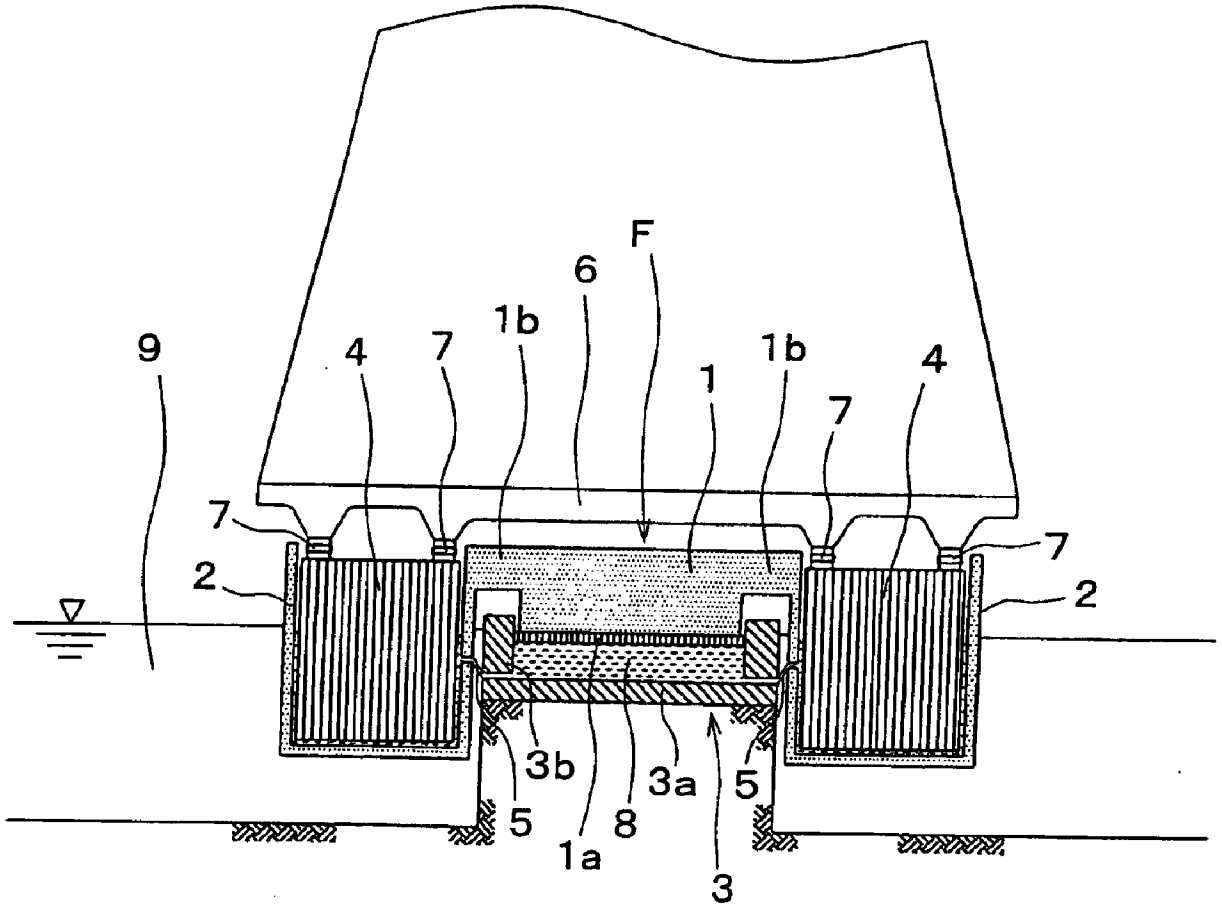
FIG. 2 is a vertical section of the floating apparatus according to the first embodiment high tide.

FIGS. 1 and 2 show an automatic level-control floating apparatus according to a first embodiment of the present invention at low tide and high tide, respectively.

With reference to FIGS. 1 and 2, protrusions S1, one of which is shown, are formed on the sea bottom S. A cylindrical supporting tank (fixed casing) 3 made of steel rests on each protrusion S1 and includes a bottom plate 3*a* and a peripheral wall 3*b*. The top of the supporting tank 3 is open to the atmosphere. The bottom plate 3*a* is fixed on the top of the protrusion S1. The peripheral wall 3*b* stands vertically on the periphery of the bottom plate 3*a*. A top portion of the peripheral wall 3*b* protrudes above seal level. The supporting tank 3 is filled with liquid 8.

A displacer type float F consists of a cylindrical piston body 1 and two cylindrical floating tanks 2. The outer diameter of the piston body 1 is slightly smaller than the inner diameter of the peripheral wall 3*b* of the supporting tank 3. The piston body 1 is floating on the liquid 8 in the floating tank 3 and can vertically reciprocate in this tank 3. A top portion of the piston body 1 protrudes into the atmosphere above sea level. The bottom of the piston body 1 is fitted with an optional piston part 1*a*, which can vertically slide in the tank wall 3*b*. The piston body 1 has two connecting arms 1*b* formed on diametrically opposite sides of its top. The connecting arms 1*b* extend outward radially of the piston body 1 beyond the tank wall 3*b* and protrusion S1. The outer end of each supporting arm 1*b* is connected integrally with one of the floating tanks 2. The tops of the floating tanks 2 are open to the atmosphere. The floating tanks 2 are filled with liquid, as is the case with the supporting tank 3. A lower portion of each floating tank 2 that is larger than its half is immersed in the sea. The floating tanks 2 are floating on the sea around the protrusion S1 on the sea bottom S.

The connecting arms 1*b* and floating tanks 2 are bilaterally symmetrical around and integral with the piston body 1. A cylindrical floating body 4 is floating on the liquid in each floating tank 2. The outer diameter of the floating bodies 4 are slightly smaller than the inner diameter of the floating tanks 2.

The interior of each floating tank 2 is connected with the interior of the supporting tank 3 by a polyethylene hose or another flexible and elastic communicating tube (line) 5, through which the liquid in them can freely flow between them.

A pontoon bridge (superstructure) 6 rests on the symmetrical floating bodies 4 in bilateral symmetry and in balance through shoes or other connectors 7, which allow the bridge 6 and each floating body 4 to be displaced relative to each other.

As the height of tide (the tide level) changes, the piston body 1 and floating tanks 2 vertically move, changing the liquid level in the supporting tank 3, where the piston body is floating. As the liquid level changes, the liquid moves through the communicating tubes 5, changing the liquid levels in the floating tanks 2. As a result, the liquid levels in the three tanks 2 and 3 are kept adjusted to the same height. How much the liquid levels change depends on the ratio between the cross-sectional areas of the piston body 1 and the interior of each floating tank 2. Likewise, it depends on this area ratio how much the floating bodies 4 in the floating tanks 2 vertically move.

As the sea level changes, the displacer-type float F, which is floating on the sea, is vertically moved by its buoyancy without requiring motive power. The float F could be floated on a lake or in a reservoir or the like with a similar effect.

Thus, even if the height of tide rises, the floating tanks 2 move upward together with the piston body 1, which is fixed to them. The upward movement of the piston body 1 in the supporting tank 3 causes part of the liquid under the floating bodies 4 in the floating tanks 2 to flow into the tank 3, so that the bodies 4 move downward in the tanks 2.

The upward movement of the floating tanks 2 due to the rising tide and the downward movement of the floating bodies 4 in them are roughly equal to each other and cancel each other out. Accordingly, the levels of the floating bodies 4 are kept constant. Likewise, when the height of tide falls, the levels of the floating bodies 4 are kept constant.

Thus, even if the sea level either rises or falls, the levels of the floating bodies 4 are kept constant, so that the level of the pontoon bridge 6 on the bodies 4 is constant. Even if the bridge 6 crosses the sea between two lands, and even when the sea level changes, the level of the bridge 6 is kept constant. Accordingly, if the bridge 6 is initially horizontal, it is kept horizontal.

In this embodiment, the supporting tank 3 rests on the sea bottom. Alternatively, a supporting tank may rest on a bearing pile set on the sea bottom, as shown in FIGS. 3 and 4, which show an automatic level-control floating apparatus according to a second embodiment of the present invention.

Figure 3:
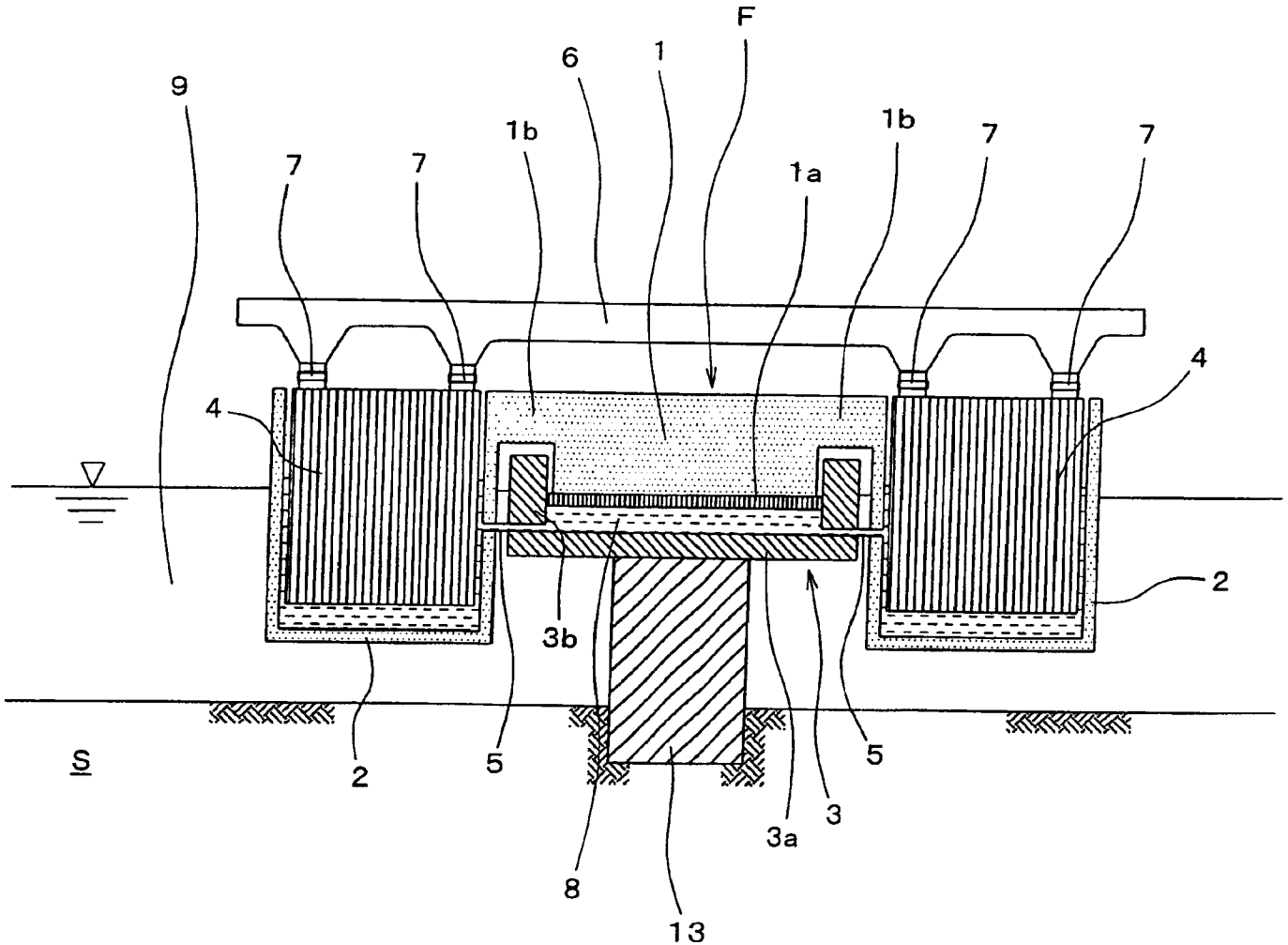
FIG. 3 is a vertical section of an automatic level-control floating apparatus according to a second embodiment of the present invention at low tide.
Figure 4:
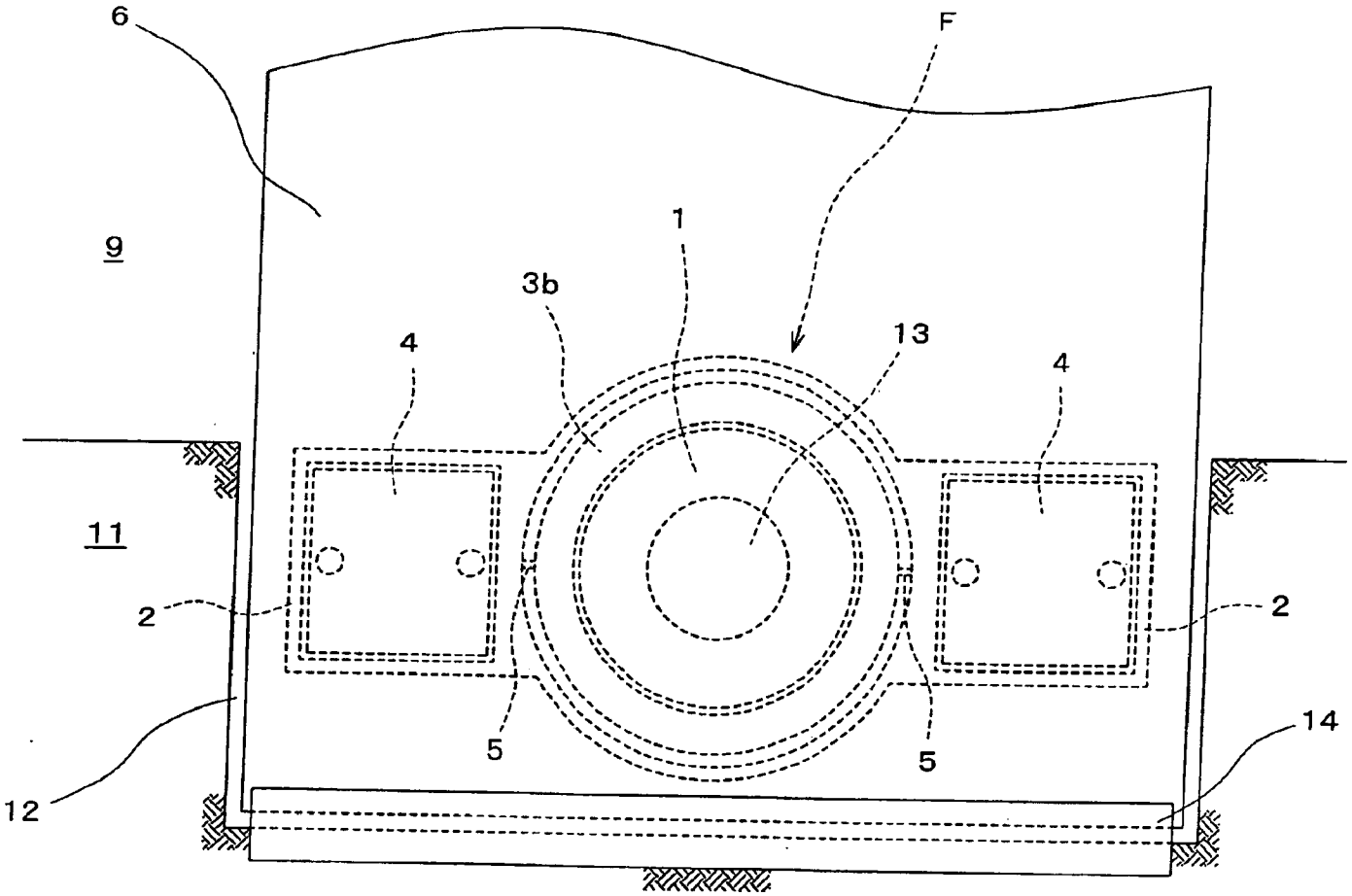
FIG. 4 is a top plan of an end portion of the floating apparatus according to the second embodiment.

With reference to FIGS. 3 and 4, a quay wall 11 is formed with a recess 12, where a columnar bearing pile (a support) 13 is set with its axis roughly vertical on the bottom S of the sea 9. A cylindrical supporting tank 3 is fixed on the top of the pile 13 coaxially with it. The bottom of a piston body 1 is fitted with an optional circular piston part 1*a*, which can vertically slide in the supporting tank 3. Two floating tanks 2 are fixed integrally with the piston body 1. One end of a pontoon bridge 6 and the quay wall 11 are connected by a connecting plate 14.

It is preferable that a partition (not shown) be set on the open side of the recess 12 to prevent the entrance of the waves from the sea 9 into the recess 12 so that the floating tanks 2 cannot shake.

The other parts of the floating apparatus are common to the first and second embodiments and assigned the same reference numerals for the two embodiments, without being described below.

The floating tanks 2 are square in horizontal section and connected integrally with diametrically opposite sides of the piston body 1. Alternatively, the floating tanks 2 might be semicircular in horizontal section and connected integrally with the side of the piston body 1 that is away from the quay wall 11.

This embodiment, where the supporting tank 3 rests on the bearing pile 13, is suitable if the sea bottom S is soft.

In each of the first and second embodiments, the floating tanks 2 are positioned in bilateral symmetry around the piston body 1 and connected integrally with diametrically opposite sides of this body 1. Alternatively, a piston body may be provided in symmetry around a floating tank, as shown in FIGS. 5*a* and 5*b*, which show an automatic level-control floating apparatus according to a third embodiment of the present invention at low tide and high tide, respectively.

Figure 5:
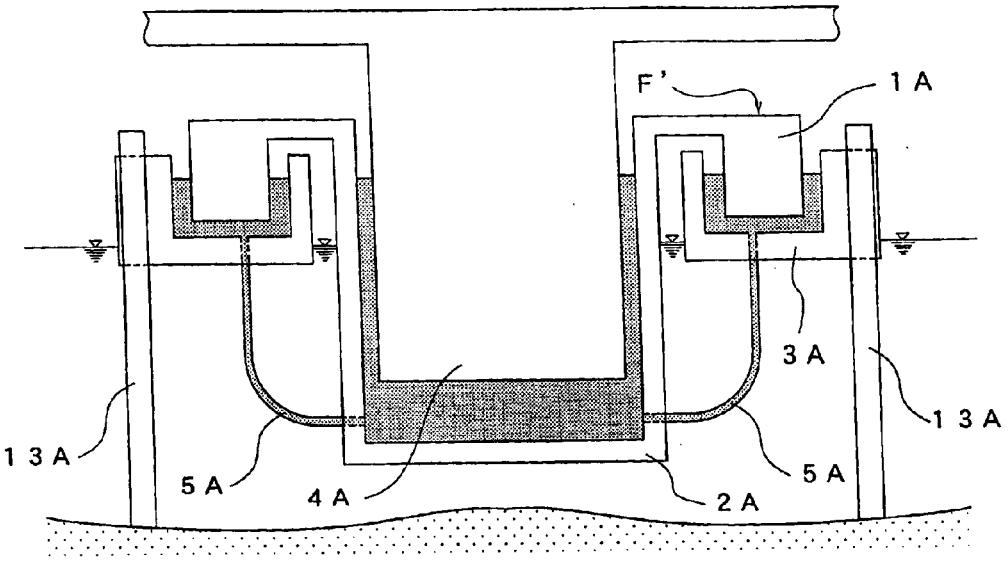
FIGS. 5*a* and 5*b* are vertical sections of an automatic level-control floating apparatus according to a third embodiment of the present invention at low tide and high tide, respectively.
Figure 5:
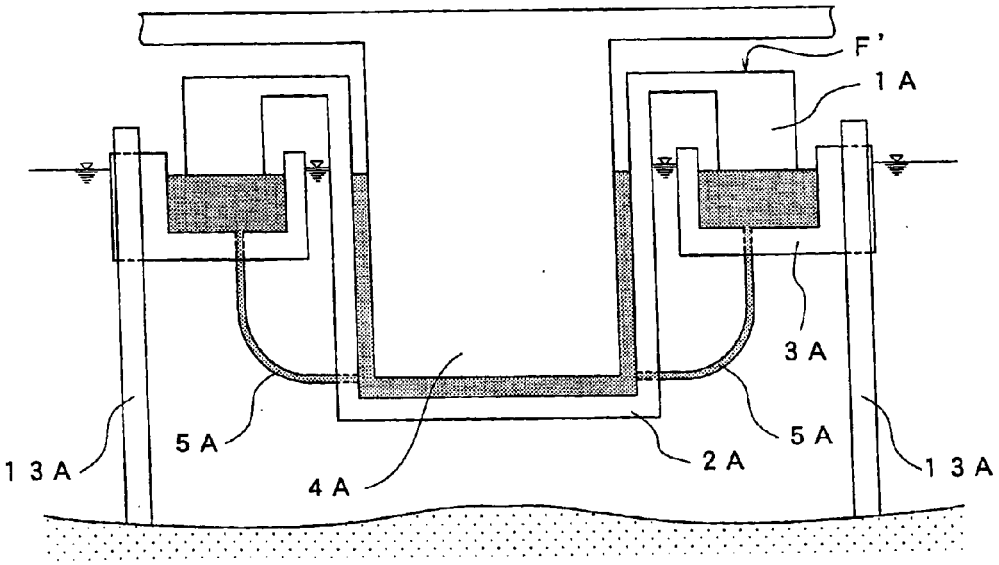

With reference to FIGS. 5*a* and 5*b*, two or more bearing piles 13A, which may be steel pipes, are set at regular intervals in a circle on the sea bottom. An annular supporting tank 3A is fixed on the bearing piles 13A. A displacer-type float F' consists of an annular piston body 1A and a cylindrical floating tank 2A. The piston body 1A can move vertically in the supporting tank 3A. The floating tank 2A is positioned within the piston body 1A coaxially with it and connected to it. A floating body 4A is floating on the liquid in the floating tank 2A and can vertically reciprocate. The tanks 2A and 3A are connected together by a suitable number of flexible connecting tubes 5A.

Figure 6:
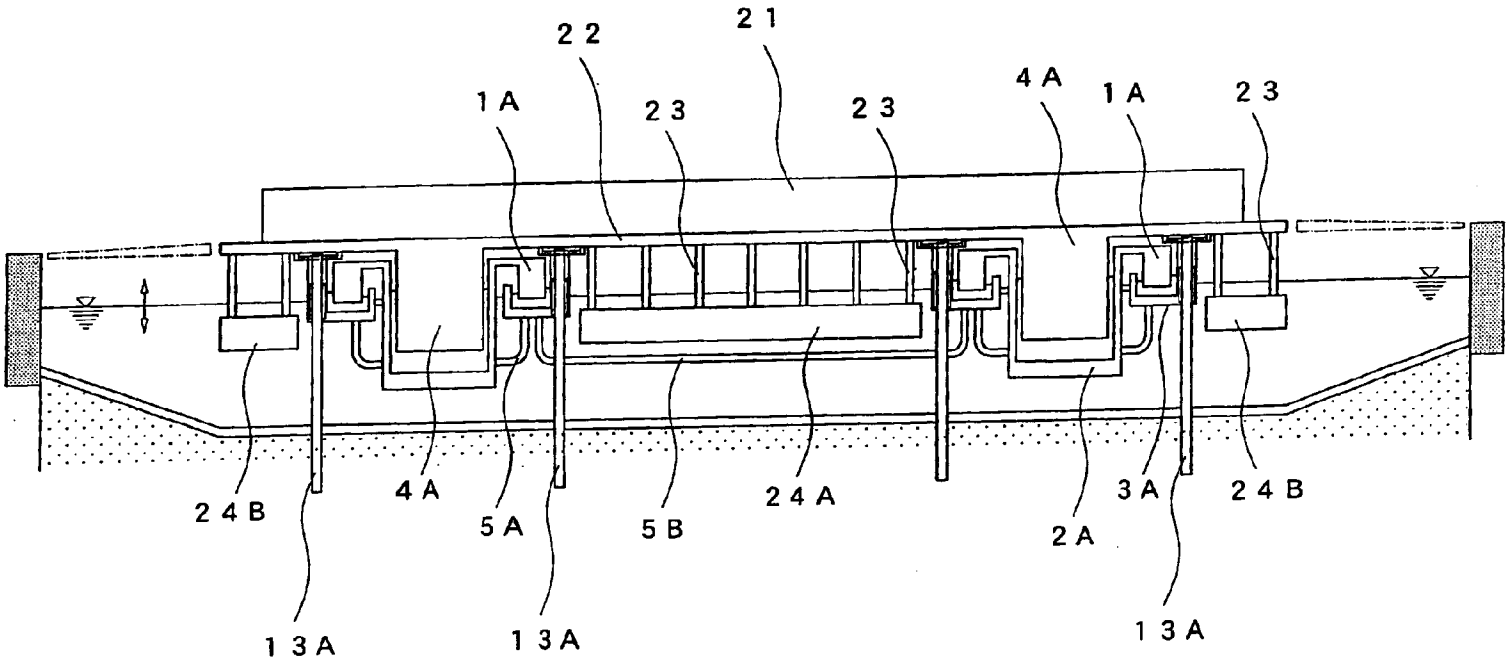
FIG. 6 is a vertical section showing a floating floor supported on automatic level-control floating apparatuses according to the third embodiment.

FIG. 6 shows a floating floor 21 supported on automatic level-control floating apparatuses according to the third embodiment. The floating floor 21 is rectangular in plan view and supported near its four corners on floating apparatuses as shown in FIGS. 5*a* and 5*b*.

With reference to FIG. 6, the floating floor 21 lies on a platform 22, which rests on the floating bodies 4A in floating tanks 2A. The platform 22 also rests on struts 23 standing on other floating bodies 24A and 24B. There is a sufficient clearance between the platform 22 and each supporting tank 3A so that the vibration of the tank 3A is not transmitted to the platform 22 when an earthquake or the like occurs.

Figure 7:
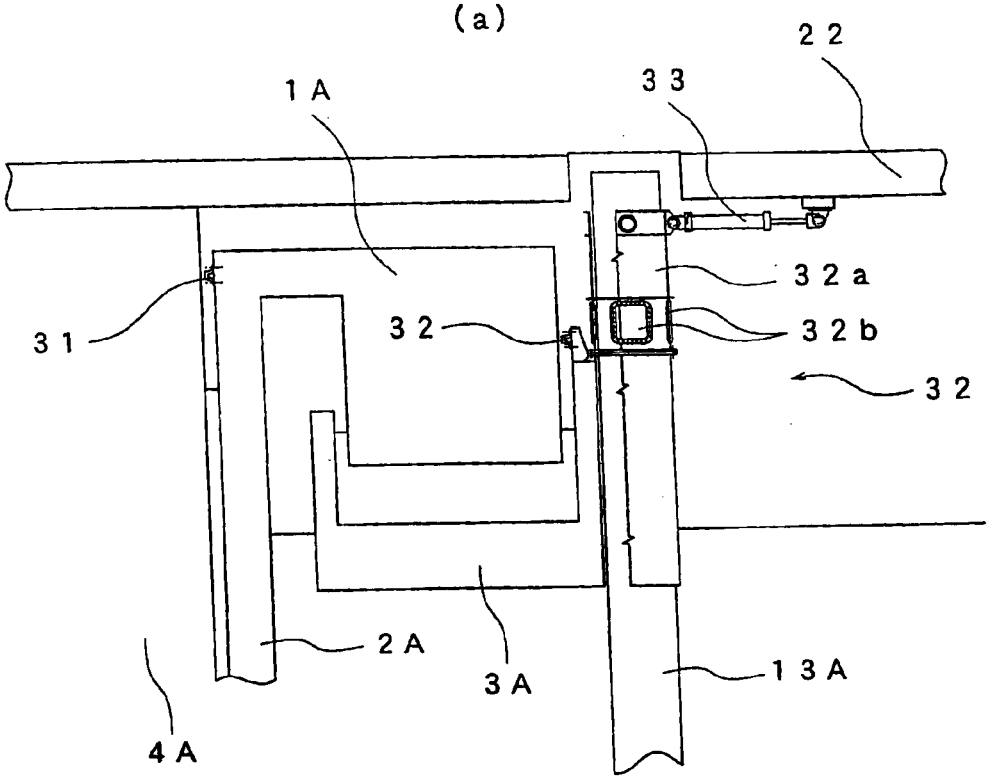
FIG. 7*a* is a vertical section of part of an automatic level-control floating apparatus according to the third embodiment.
FIG. 7*b* is a vertical section of an upper portion of the bearing pile shown in FIG. 7*a*.
Figure 7:
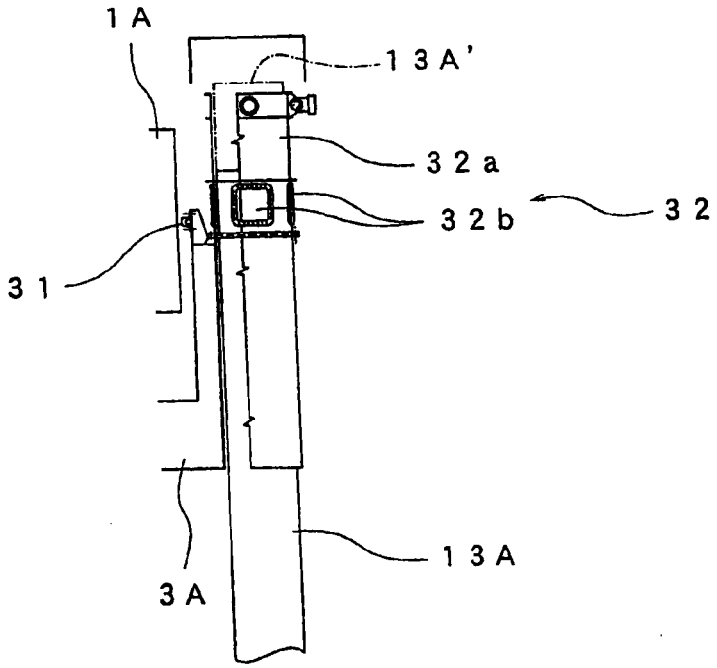

As shown in FIGS. 7*a* and 7*b*, the inner periphery of each floating tank 2A is fitted with fenders 31 as buffers between it and the periphery of the associated floating body 4A. Likewise, the outer peripheral wall of each supporting tank 3A is fitted with fenders 32 inside it as buffers between this tank 3A and the associated piston body 1A. The fenders 32 prevent the deviation of the displacer-type floats F.

Each bearing pile 13A is fitted with an air-pad casing jack 32 near its top. The casing jack 32 includes a movable sleeve 32*a*, which is fixed to the supporting tank 3A and can slide on the bearing pile 13A. The movable sleeve 32*a* is fitted with air pads 32*b* in the form of bags, which can be inflated with pressurized air to hold the movable sleeve 32*a* in a predetermined position on the bearing pile 13A. If the bearing piles 13A sink unevenly, the supporting tank 3A inclines. In this case, it is possible to return the supporting tank 3A to its initial position by releasing the air pads 32*b* once so that this tank 3A can be lifted by its buoyancy, and by then inflating the pads 32*b* again so that the casing jacks 32 can be held on the bearing piles 13A. This makes it possible to adjust the level of the supporting tank 3A in a short time.

As shown in FIG. 7*b*, each bearing pile 13A needs to be taller with a supplementary pile 13A' fixed on its top if the supporting tank 3A greatly goes down.

Figure 8:
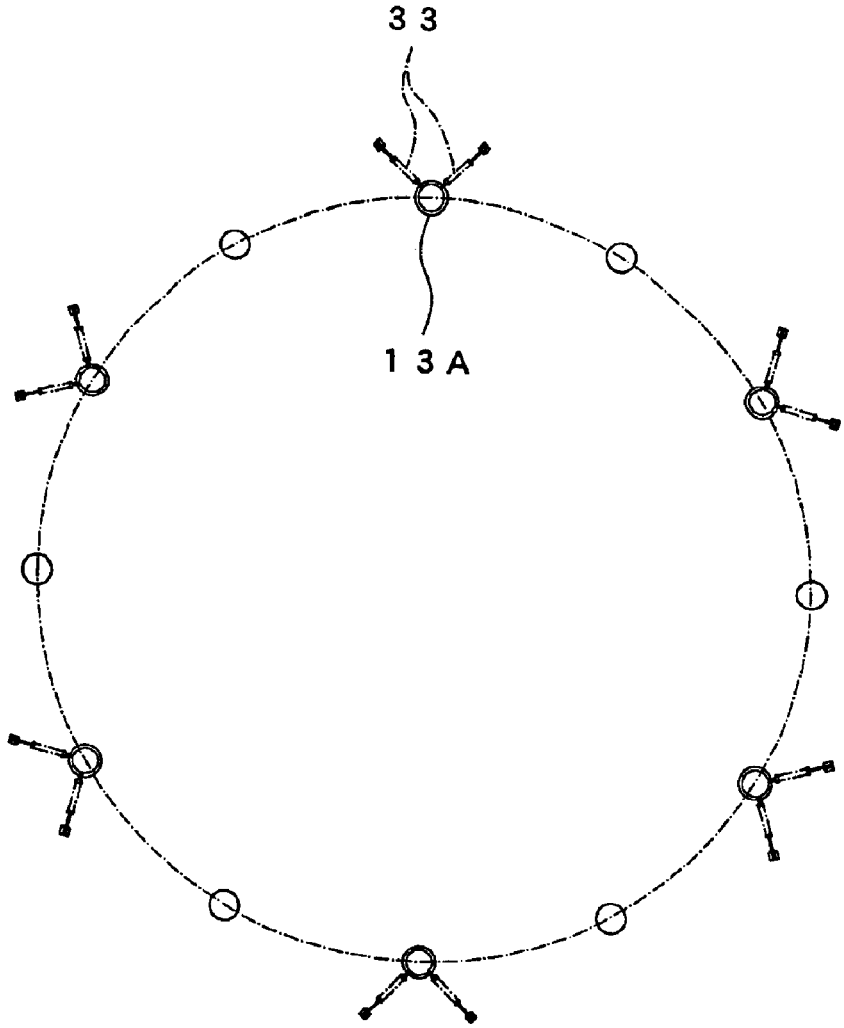
FIG. 8 is a view showing the relationship between the bearing pile and dampers shown in FIG. 7*a*.

As shown in FIG. 8, the top of every other bearing pile 13A (movable sleeve 32*a*) is connected to the platform 22 through a pair of dampers 33, which extend outward. Normally, the dampers 33 hold the displacement of the platform 22 at the minimum. When an earthquake occurs, or when an overload is exerted otherwise, the dampers 33 can be released so that no overload can be transmitted to the platform 22.

For a pontoon bridge or the like across a deep valley, it is difficult to set bearing piles as described above. In such a case, the bearing piles may be replaced with tension anchors as shown in FIG. 9.

Figure 9:
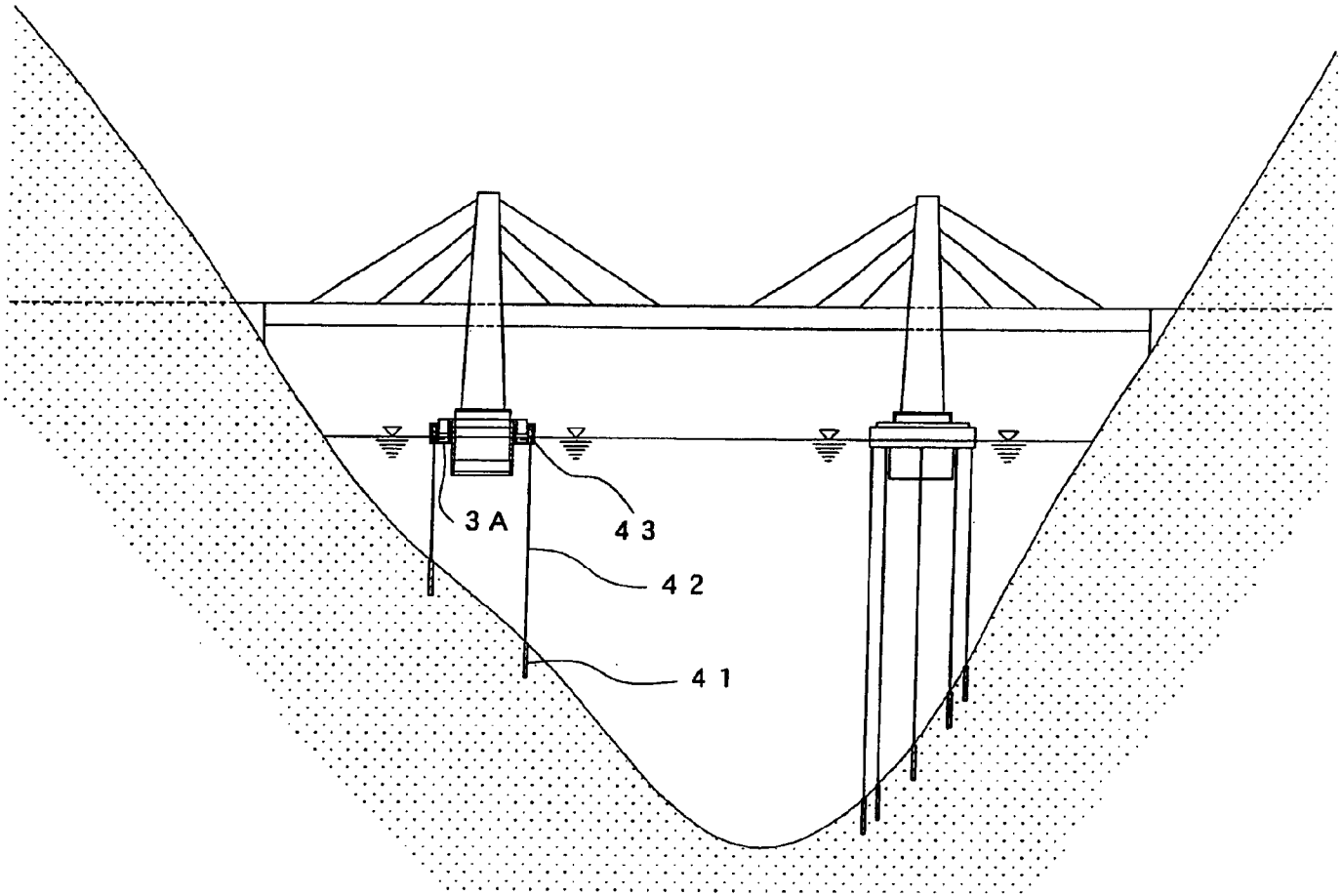
FIG. 9 is a view showing another embodiment of the present invention.

With reference to FIG. 9, anchors 41 are fixed to the water bottom. A supporting tank 3A is connected to the anchors 41 by chains (or wire ropes) 42. The upper end of each chain 42 is fixed to the supporting tank 3A by a fastener 43.

What is claimed is:

1. An automatic level-control floating apparatus comprising:

a fixed casing resting on the water bottom or supported by a support set on the water bottom;

the fixed casing having a top open to the atmosphere;

the fixed casing filled with liquid;

a piston body floating on the liquid in the fixed casing in such a manner that the piston body can move vertically;

a floating tank integral with and positioned outside the piston body;

the floating tank floating on the water;

the floating tank having a top open to the atmosphere;

the floating tank filled with liquid;

a floating body for supporting the bottom of a superstructure above the water;

the floating body floating on the liquid in the floating tank in such a manner that the floating body can move vertically; and a communicating line connecting the interior of the floating tank and the interior of the fixed casing so that the liquid can flow between the tank and the casing;

wherein the level of the floating body can be controlled automatically.

2. An automatic level-control floating apparatus according to claim 1, wherein the communicating line is formed out of flexible and elastic material.

3. An automatic level-control floating apparatus according to claim 1, wherein the ratio of the cross-sectional area of the piston body to the cross-sectional area of the interior of the floating tank is about 1.

4. An automatic level-control floating apparatus according to claim 1, wherein the superstructure is a pontoon bridge.

5. An automatic level-control floating apparatus according to claim 2, wherein the superstructure is a pontoon bridge.

6. An automatic level-control floating apparatus according to claim 3, wherein the superstructure is a pontoon bridge.

7. An automatic level-control floating apparatus according to claim 2, wherein the ratio of the cross-sectional area of the piston body to the cross-sectional area of the interior of the floating tank is about 1.

8. A structure comprising:

a plurality of automatic level-control floating apparatuses according to claim 1;

the floating apparatuses spaced from each other;

a superstructure positioned over the floating apparatuses; and connectors each interposed between the superstructure and the floating body of one of the floating apparatuses;

the connectors each allowing the superstructure and the associated floating body to be displaced relative to each other.

9. An automatic level-control floating apparatus according to claim 8, wherein the superstructure is a pontoon bridge.

10. An automatic level-control floating apparatus comprising:

a support set on the water bottom;

an annular fixed casing supported by the support;

the fixed casing having a top open to the atmosphere;

the fixed casing filled with liquid;

an annular piston body floating on the liquid in the fixed casing in such a manner that the piston body can move vertically;

a floating tank integral with and positioned within the piston body;

the floating tank floating on the water;

the floating tank having a top open to the atmosphere;

the floating tank filled with liquid;

a floating body for supporting the bottom of a superstructure above the water;

the floating body floating on the liquid in the floating tank in such a manner that the floating body can move vertically; and a communicating line connecting the interior of the floating tank and the interior of the fixed casing so that the liquid can flow between the tank and the casing;

wherein the level of the floating body can be controlled automatically.

11. An automatic level-control floating apparatus according to claim 10, wherein the superstructure is a floating floor.

12. An automatic level-control floating apparatus according to claim 10, wherein the support comprises a tension anchor including:

an anchor fixed to the water bottom; and a chain or a wire rope connecting the anchor and the fixed casing.

13. A structure comprising:

a plurality of automatic level-control floating apparatuses according claim 2;

the floating apparatuses spaced from each other;

a superstructure positioned over the floating apparatuses; and connectors each interposed between the superstructure and the floating body of one of the floating apparatuses;

the connectors each allowing the superstructure and the associated floating body to be displaced relative to each other.

14. A structure comprising:

a plurality of automatic level-control floating apparatuses according claim 3:

the floating apparatuses spaced from each other;

a superstructure positioned over the floating apparatuses; and connectors each interposed between the superstructure and the floating body of one of the floating apparatuses, the connectors each allowing the superstructure and the associated floating body to be displaced relative to each other.

* * * * *